US005340197A

United States Patent [19]

Vogtherr

[11] Patent Number: 5,340,197

[45] Date of Patent: Aug. 23, 1994

[54] ONE-PIECE SEAT SHELL

[75] Inventor: Burkhard Vogtherr, Kandern-Holzen, Fed. Rep. of Germany

[73] Assignee: Fritz Hansen A/S, Allerod, Denmark

[21] Appl. No.: 927,264

[22] PCT Filed: Dec. 22, 1991

[86] PCT No.: PCT/EP91/02491

§ 371 Date: Sep. 21, 1992

§ 102(e) Date: Sep. 21, 1992

[87] PCT Pub. No.: WO92/12654

PCT Pub. Date: Aug. 6, 1992

[30] Foreign Application Priority Data

Jan. 20, 1991 [DE] Fed. Rep. of Germany .... G9100572

[51] Int. Cl.[5] ..... A47C 7/02

[52] U.S. Cl. ..... 297/452.12; 297/452.33; 297/285; 297/452.23

[58] Field of Search ..... 297/354, 460, 457, 285, 297/299, 452.15, 452.23, 452.31, 452.33, 452.12, 454.1

[56] References Cited

U.S. PATENT DOCUMENTS

| | | | |
|---|---|---|---|
| 2,530,924 | 11/1950 | Turner | 297/457 |
| 2,818,107 | 12/1957 | Thaden | 297/457 |
| 2,865,436 | 12/1958 | Thorn | 297/457 |
| 4,533,174 | 8/1985 | Fleishman | 297/457 |
| 4,679,848 | 7/1987 | Spierings | 297/460 |
| 4,856,846 | 8/1989 | Lohmeyer | 297/457 |
| 4,962,964 | 10/1990 | Snodgross | 297/460 |

FOREIGN PATENT DOCUMENTS

| | | |
|---|---|---|
| 0196819 | 10/1986 | European Pat. Off. . |
| 8103114 | 11/1981 | World Int. Prop. O. . |
| 8704909 | 8/1987 | World Int. Prop. O. . |

*Primary Examiner*—P. Austin Bradley
*Assistant Examiner*—James Miner
*Attorney, Agent, or Firm*—Fred Philpitt

[57] ABSTRACT

A one-piece seat shell having a backrest and a seat connected by an angled transition section that contains a plurality of slots to permit resilient deflection of the backrest with respect to the seat.

1 Claim, 1 Drawing Sheet

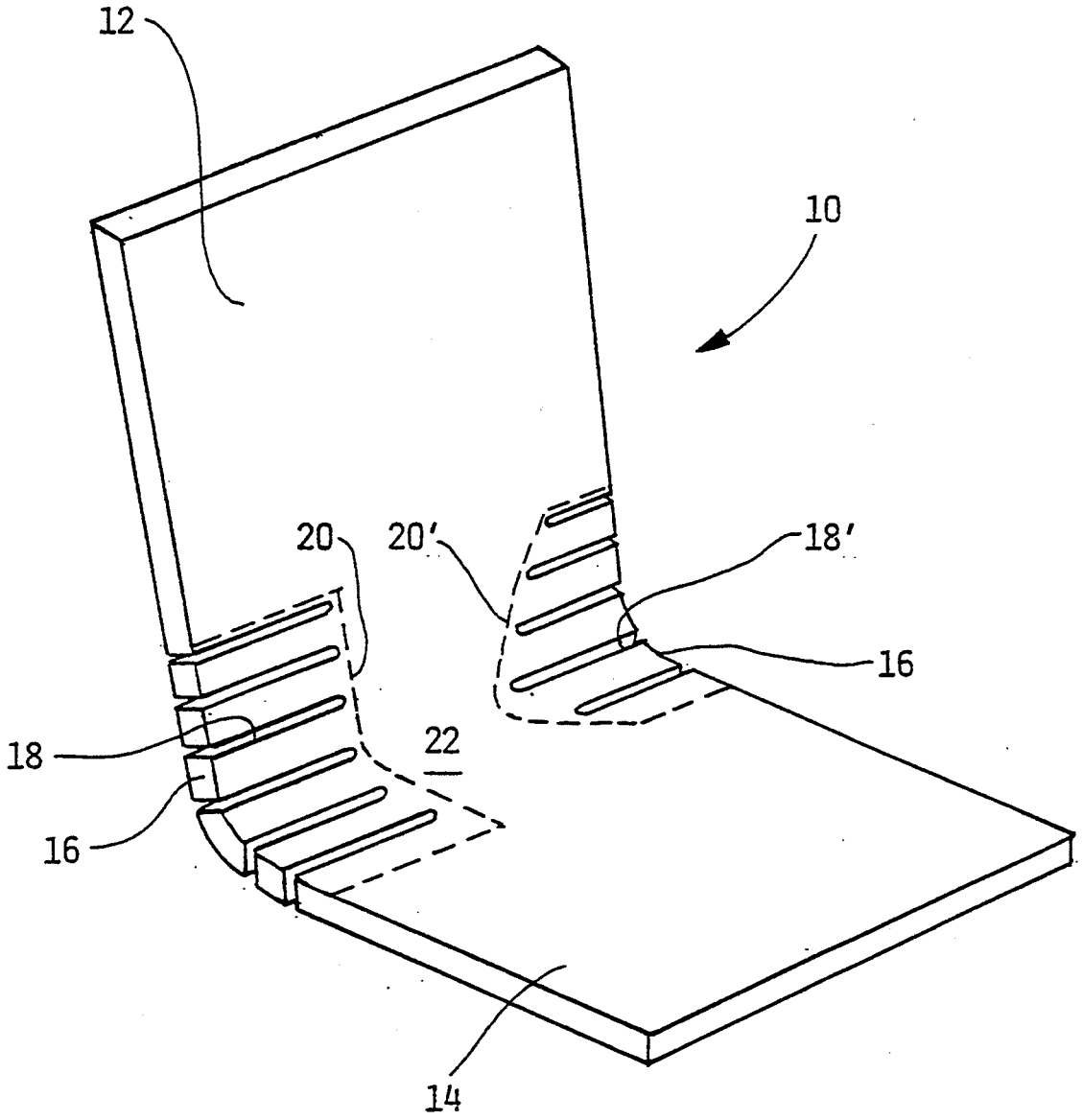
12
10
20
20'
18'
16
18
22
16
14

ONE-PIECE SEAT SHELL

My invention pertains to a one-piece seat shell having a backrest and a seat connected by a curved transition section.

SUMMARY OF THE INVENTION

My invention pertains to a one-piece seat shell having a backrest and a seat connected by a curved transition section that permits resilient deflection of the backrest with respect to the seat.

BRIEF DESCRIPTION OF THE DRAWING

The drawing is a perspective view of the one-piece seat shell.

DESCRIPTION

The drawing shows a seat shell 10 made of rigid basic material (for example plywood) having a backrest 12, a seat 14 and an angled transition region 16 connecting the two. A plurality of slots 18' are provided in the transition region 16 and optionally also in the adjacent region of the backrest 12 and the seat 14. Slots 18' extend in the transverse direction and extend parallel to each other. Some slots may be inclined at a slight angle, in the manner of a pencil of rays. The slots 18' facilitate a resilient deflection of the backrest 12 with respect to the seat 14.

The area indicated by broken lines 20' defines the region 22 of the seat shell which is subject to spring action or resilient deflection. The slots can be covered by easily cut coverings.

I claim:

1. A one piece seat shell (10) comprising (a) a backrest (12), (b) a seat (14), (c) a curved transition section (16) smoothly and arcuately interconnecting the backrest (12) and the seat (14), (d) two groups of parallel slots (18'), each group extending inwardly from a laterally exterior edge of said transition section (16), the slots (18') in each group (i) extending in a transverse direction, (ii) being of different lengths, (iii) having outer open ends and closed inner ends, (iv) the closed inner ends of said two groups of slots (18') defining between them an intermediate transition region (22) of the seat shell (10)

which transition region (22) is effective to provide a spring action, and which transition region (22) diverges from a transverse center line of said transition region (22) both outwardly towards said backrest (12) and outwardly towards said seat (14).

* * * * *